US007717839B2

(12) United States Patent
Butterworth

(10) Patent No.: US 7,717,839 B2
(45) Date of Patent: May 18, 2010

(54) MULTI-PATH INTERFOLDING APPARATUS

(75) Inventor: Tad T. Butterworth, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 225 days.

(21) Appl. No.: 12/062,675

(22) Filed: Apr. 4, 2008

(65) Prior Publication Data

US 2009/0253564 A1 Oct. 8, 2009

(51) Int. Cl.
*B31B 1/26* (2006.01)

(52) U.S. Cl. ..... 493/357; 493/415; 493/430; 493/442; 270/39.05; 270/39.06

(58) Field of Classification Search ..... 493/359, 493/357, 343, 405, 411, 413, 415, 430, 442; 270/39.05, 39.06
See application file for complete search history.

(56) References Cited

U.S. PATENT DOCUMENTS 3,490,762 A 1/1970 Nystrand
4,163,548 A * 8/1979 Nystrand ..... 270/39.07
4,254,947 A 3/1981 Trogan
4,494,741 A 1/1985 Fischer et al.
4,708,332 A 11/1987 Besemann
4,717,135 A * 1/1988 Hathaway ..... 270/39.02
4,874,158 A * 10/1989 Retzloff ..... 270/39.02
5,088,707 A * 2/1992 Stemmler ..... 270/39.02
5,147,273 A 9/1992 Rottmann et al.
5,310,398 A 5/1994 Yoneyama
6,090,467 A 7/2000 Yip
6,165,116 A 12/2000 White
6,213,346 B1 4/2001 Skerrett et al.
6,213,927 B1 * 4/2001 De Matteis et al. ..... 493/360
6,228,014 B1 5/2001 De Matteis et al.
6,431,038 B2 8/2002 Couturier
6,539,829 B1 4/2003 Kauppila et al.
6,689,038 B2 * 2/2004 White ..... 493/360
7,008,364 B2 3/2006 Ochsenbauer
7,060,016 B2 6/2006 Cipolli
7,121,994 B2 10/2006 Haasl
7,146,777 B2 12/2006 Focke et al.
7,306,554 B2 * 12/2007 Couturier et al. ..... 493/427

(Continued)

FOREIGN PATENT DOCUMENTS

EP 1 371 593 A2 12/2003

(Continued)

*Primary Examiner*—Hemant M Desai
(74) *Attorney, Agent, or Firm*—Reinhart Boerner Van Deuren P.C.

(57) ABSTRACT

An interfolding apparatus and method, utilize, first and second sheet-cutting-and-overlapping arrangements and an interfolding arrangement simultaneously mounted and operatively interconnected in a common frame, for alternatively selectively forming a first or a second interfolded pattern having a given folded width, without replacement of components of the interfolding apparatus. The first interfolded pattern is formed from a first stream of overlapped sheets of a first length cut from a web of sheet material fed along a first path extending through the first sheet-cutting-and-overlapping arrangement to the interfolding arrangement. The second interfolded pattern is formed from a stream of overlapped sheets of a second length cut from the web of sheet material fed along a second path extending through the second sheet-cutting-and-overlapping arrangement to the interfolding arrangement.

26 Claims, 7 Drawing Sheets

U.S. PATENT DOCUMENTS

| | | | |
|---|---|---|---|
| 2005/0082332 | A1 | 4/2005 | White |
| 2006/0052228 | A1 | 3/2006 | De Matteis |
| 2007/0082800 | A1 | 4/2007 | Kauppila |
| 2007/0197365 | A1 | 8/2007 | De Matteis |
| 2007/0203007 | A1 | 8/2007 | De Matteis |

FOREIGN PATENT DOCUMENTS

| | | | |
|---|---|---|---|
| EP | 1 514 677 | A1 | 3/2005 |
| EP | 1 820 763 | A1 | 8/2007 |
| EP | 1 826 165 | A1 | 8/2007 |

* cited by examiner

MULTI-PATH INTERFOLDING APPARATUS

FIELD OF THE INVENTION

This invention generally relates to interfolding of a stream of sheets, such as hand towels, and more particularly to interfolding sheets having the same folded width in two different interfolding patterns from sheets of two different lengths.

BACKGROUND OF THE INVENTION

A variety of types of machines and processes exist for making multi-folded paper towels and the like by producing stacks of interfolded sheets having a desired folded width.

The "interfolding" is accomplished by partially overlapping the individual sheets in the stack during the folding process. The overlapping and folding is carried out in such a manner that, with the stack loaded into a dispenser when a sheet is pulled out of the dispenser, a panel of the following sheet is also pulled out of the dispenser to facilitate the next user in pulling the next towel from the dispenser. Multi-panel interfolded sheets of this type often have three panels forming a Z-folded shape or four panels having a W-folded shape. Other folded shapes and numbers of panels are sometimes used.

In one approach to forming such stacks of interfolded multi-panel sheets, a single web of material is fed sequentially through a sheet-cutting-and-overlapping arrangement and then to an interfolding arrangement. The web of sheet material is fed along a single path which extends through the sheet-cutting-and-overlapping arrangement to the interfolding arrangement, for forming a desired interfolded pattern of sheets having a desired folded panel width, sheet length, and folding pattern.

The sheet-cutting-and-overlapping arrangement is configured for generating a stream of sheets having the desired length which are fed along the path to the interfolding arrangement. The stream of sheets moves through the interfolding arrangement at an interfolding feed speed. The sheet-cutting-and-overlapping arrangement generates an overlap speed, of the stream of sheets along the path upstream from the interfolding arrangement, which is higher than the interfolding feed speed.

Due to the difference between the interfolding feed speed and the overlap speed, as each sheet in the stream of sheets transitions from the sheet-cutting-and-overlapping arrangement to the interfolding arrangement, a portion of the sheet forms a bulge and the trailing edge of the sheet eventually pulls free in such a manner that the leading edge of the following sheet along the path will slide under the preceding sheet by a desired overlap amount, which is often selected to be substantially equal to the desired folded width of the interfolded stack. With successive sheets in the stream of sheets overlapped in this manner, the interfolding arrangement then folds the overlapped sheets in such a manner that the interfolded stack is produced.

One example of an interfolding apparatus of the type described above is shown in commonly assigned U.S. Published Patent Application No. US 2007/0082800, to Kauppila. The disclosure and teachings of the Kauppila application are incorporated herein in their entireties by reference.

In prior interfolding apparatuses and methods that utilize a stream of sheets cut from a single web of material fed along a single path, parameters such as the sheet length, the overlap length, folded shape, and the folded width of the interfolded stack are all parameters that are set by the configuration of mechanical components within the interfolding apparatus.

For example, in the Kauppila reference, the apparatus includes a cutting roll interacting with a lap roll for cutting the web of material into sheets of the desired lengths, and feeding those sheets to a pair of interfolding rolls at an overlap speed. The configuration of the interfolded stack, and the shape of the folded sheets therein, are set by physical parameters such as the relative diameters and rotational speeds of the cutting roll, the overlap roll, and the interfolding rolls. With such an arrangement, if it is desired to change from a three-panel, Z-shaped, folded shape having a given width, to a four-panel, W-shaped, folded shape, having the same folded width as the three-panel product, it is typically necessary to physically replace the lap roll and cutting roll with rolls having a different diameter to produce cut sheets of a different length and to move those sheets along the path at a different desired overlap speed which is dependent upon the peripheral speed of the overlap roll. The necessary disassembly and reassembly of the interfolding apparatus with different components, to switch from a production run of three-panel towels to a production run of four-panel towels, for example, involves considerable expenditure of time and effort which it would be desirable to eliminate.

In an attempt to address this problem, U.S. Published Patent Application No. US 2007/0203007, to De Matteis proposes the use of an interfolding machine having a modular structure in which groupings of the rollers are mounted together in a common mounting structure in such a manner that they can be removed and replaced as a module, independent from a main portion of a frame of the interfolding apparatus. This approach adds considerable weight, cost and complexity to the overall construction of the interfolding apparatus and would still appear to require a significant amount of machine downtime and non-productive manpower cost for changing from one module to another.

It is desirable, therefore, to provide an improved interfolding apparatus and method which is capable of producing multiple interfolded patterns from a stream of sheets fed from a single web of material, which avoids one or more of the problems discussed above.

BRIEF SUMMARY OF THE INVENTION

The invention provides an improved multi-fold interfolding apparatus and method, which utilize first and second sheet-cutting-and-overlapping arrangements and an interfolding arrangement simultaneously mounted and operatively interconnected in a common frame, for alternatively selectively forming a first or a second interfolded pattern having the same folded width, without replacement of components of the interfolding apparatus. The first interfolded pattern is formed from a first stream of overlapped sheets of a first length cut from a web of sheet material fed along a first path extending through the first sheet-cutting-and-overlapping arrangement to the interfolding arrangement. The second interfolded pattern is formed from a stream of overlapped sheets of a second length cut from the web of sheet material fed along a second path extending through the second sheet-cutting-and-overlapping arrangement to the interfolding arrangement.

In one form of the invention, a multi-fold towel interfolding apparatus and method produces either three-panel or four-panel products within one machine. This is accomplished by having two web paths through the machine, with both web paths feeding a common set of interfolding rolls. Threading through one web path results in a three-panel interfolded product being produced, and threading the second web path results in a four-panel product. In this manner, the need to replace the knife roll and overlap rolls, as was the case in prior interfolding apparatuses and methods in order to change the sheet length and interfolding pattern, is eliminated.

By having one set of rolls designed and dedicated to the three-panel product and the second set of rolls designed and dedicated to the four-panel product, both configured to feed the same set of interfolding rolls, two products having significantly different interfolded patterns and sheet lengths but identical folded widths can be produced on the same machine without the need to change any machine parts. The operator can change between the two products by simply threading the web through one or the other of the two web paths. As a result, two different products can be effectively and efficiently produced within one machine with minimal changeover time and effort. In alternate forms of the invention other combinations of panels, i.e. combinations other than three- and four-panel towels having the same folded width may be produced, according to the invention.

In one form of the invention, the interfolding apparatus is configured to move the streams of sheets through the interfolding arrangement at an interfolding feed speed. The first sheet-cutting-and-overlapping arrangement is configured for generating a first overlap speed which is faster than the interfolding feed speed. The second sheet-cutting-and-overlapping arrangement is configured for generating a second overlap speed which is faster than the interfolding feed speed and different from the first overlap speed.

At least one of the first and second sheet lengths may be substantially equal to an integer multiple of the folded width, so that the sheet has an integer number of panels, with each panel having a width equal to the folded width. The first sheet length may be substantially equal to a first integer multiple of the folded width, and the second sheet length may be substantially equal to a second integer multiple of the folded width, so that the first sheet has a first integer number of panels, with each panel of the first sheet having a width equal to the folded width, and the second sheet has an integer number of panels, with each panel of the second sheet having a width equal to the folded width.

The first overlap speed may be faster than the interfolding feed speed by a first overlap multiplier, which may be an integer, times the reciprocal of a first length multiplier, which may be an integer, times the folded width of the panels. The second overlap speed may be faster than the interfolding feed speed by a second overlap multiplier, which may be an integer, times the reciprocal of a second length multiplier, which may be an integer, times the folded width of the panels. For example, in one form of the invention, where the first sheet length is substantially equal to three times the folded width, to thereby form three panels, and the second sheet length is substantially equal to four times the folded width, to thereby form four panels, the first overlap speed may be one-third faster than the interfolding feed speed to overlap successive sheets by one panel width, and the second overlap speed may be one-half faster than the interfolding feed speed to overlap successive sheets by two panel widths, for achieving a first and a second interfolded pattern, respectively.

In some forms of the invention, the first sheet-cutting-and-overlapping arrangement may be configured for generating a stream of first sheets having a first sheet length, and the second sheet-cutting-and-overlapping arrangement may be configured for generating a stream of second sheets having a second sheet length different from the first sheet length. At least one of the first and second sheet lengths may be substantially equal to an integer multiple of the folded width. Both the first and second sheet lengths may be substantially equal to integer multiples of the folded width in some forms of the invention.

An interfolding arrangement, according to the invention, may include a pair of interfolding rolls operatively mounted in the frame for rotation in opposite directions to one another and forming an interfolding nip therebetween. The interfolding rolls are cooperatively configured to form a first interfolded stack of folded sheets having the folded width, from a stream of the first sheets fed along a first path extending through the interfolding nip, or alternatively, to form a second interfolded stack of folded sheets having the same folded width from a stream of the second sheets fed along a second path extending through the nip.

The interfolding rolls both rotate at the same speed and are of the same diameter, such that rotation of the interfolding rolls causes an interfolding roll peripheral speed. The first sheet-cutting-and-overlapping arrangement may include a first overlap roll rotatably mounted in the frame and having a rotational speed and diameter generating a first overlap roll peripheral speed which is faster than the interfolding roll peripheral speed. The second sheet-cutting-and-overlapping arrangement includes a second overlap roll rotatably mounted in the frame and having a rotational speed and diameter generating a second overlap roll peripheral speed which is faster than the interfolding roll peripheral speed and different from the first overlap roll peripheral speed.

The first sheet-cutting-and-overlapping arrangement may include a first sheet-cutting arrangement. In some forms of the invention, the first sheet-cutting arrangement may include a first sheet-cutting roll rotatably mounted in the frame and having a rotational speed and diameter generating a first sheet-cutting-roll peripheral speed which is substantially equal to the first overlapping roll peripheral speed. The first sheet-cutting roll is configured for receiving the web of material and cutting the web into the first sheets at the first sheet length and delivering a stream of the first sheets along the first path to the first overlapping roll at a speed equal to the first overlapping roll peripheral speed.

A second sheet-cutting-and-overlapping arrangement, according to the invention, may include a second sheet-cutting arrangement. In some forms of the invention, the second sheet-cutting arrangement may include a second sheet-cutting-roll which is rotatably mounted in the frame and has a rotational speed and diameter generating a second sheet-cutting-roll peripheral speed which is substantially equal to the second overlapping roll peripheral speed. The second sheet-cutting-roll may be configured for receiving the web of material and cutting the web into the second sheets at the second sheet length, and delivering a stream of the second sheets along the second path to the second overlapping roll at a speed equal to the second overlapping roll peripheral speed.

In one form of the invention, the first sheet length is substantially equal to three times the folded width, resulting in a folded sheet having three panels, and the second sheet length is substantially equal to four times the folded width, resulting in a folded sheet having four panels. The first overlapping roll peripheral speed is one-third faster than the interfolding roll peripheral speed, and the second overlapping roll peripheral speed is one-half faster than the interfolding roll peripheral speed.

In some forms of the invention, a common web pulling arrangement is mounted to the common frame in such a manner that the web is fed through the common pulling arrangement along either the first or the second web path. In other embodiments of the invention, a first web pulling arrangement is provided for operation with the web of material traveling along the first web path, and a separate second web pulling arrangement is provided for pulling the web along the second web path.

The invention may also be practiced in the form of a method for constructing and/or operating a multi-path interfolding apparatus, according to the invention.

A multi-path interfolding method, according to the invention, may include simultaneously mounting and operatively connecting first and second sheet-cutting-and-overlapping arrangements and an interfolding arrangement in a common frame to form an interfolding apparatus. The method may further include alternatively selectively forming a first interfolded pattern having a folded width from the overlapped sheets of a first length cut from a web of sheet material fed along a first path extending through the first sheet-cutting-and-overlapping arrangement to the interfolding arrangement, or, forming a second interfolded pattern of the same folded width from overlapped sheets of a second length cut from the web of sheet material fed along a second path extending through the second sheet-cutting-and-overlapping arrangement to the interfolding arrangement. A method, according to the invention, may include threading a web of material through the first cutting-and-overlapping arrangement, and operating the first cutting-and-overlapping arrangement and the interfolding arrangement to form the first interfolding pattern of overlapped first sheets. A method may further include unthreading the web of material from the first cutting-and-overlapping arrangement and then threading the web of material through the second cutting-and-overlapping arrangement. The method may further then include operating the second cutting-and-overlapping arrangement and the interfolding arrangement to form the second interfolded pattern of overlapped second sheets.

In some forms of the invention, the second cutting-and-overlapping arrangement is shut down while operating the first cutting-and-overlapping arrangement and the interfolding arrangement to form the first interfolded pattern of overlapped first sheets. In similar fashion, the first cutting-and-overlapping arrangement may be shut down while operating the second cutting-and-overlapping arrangement and the interfolding arrangement to form the second interfolded pattern of overlapped second sheets.

In some forms of the invention, wherein a vacuum is utilized for manipulating the sheets as they travel along either the first or the second path, the invention may include shutting off the vacuum to the unused one of the first or second sheet-cutting-and-overlapping arrangements.

In one form of the invention, a multi-path interfolding apparatus includes first and second sheet-cutting-and-overlapping arrangements and an interfolding arrangement, simultaneously mounted and operatively interconnected in a common frame, for alternatively selectively forming a first interfolded pattern having a folded width from overlapped sheets of a first length cut from a web of sheet material fed along a first path extending through the first sheet-cutting-and-overlapping arrangement to the interfolding arrangement, or forming a second interfolded pattern having the same folded width from overlapped sheets of a second length cut from the web of sheet material fed along a second path extending through the second sheet-cutting-and-overlapping arrangement to the interfolding arrangement.

The interfolding arrangement may include a pair of interfolding rolls, having substantially the same diameter, operatively mounted for rotation in opposite directions to one another at the same rotational speed to thereby generate a substantially identical interfolding roll peripheral speed. The pair of interfolding rolls form an interfolding nip therebetween with both the first and second paths extending through the interfolding nip. The interfolding rolls are cooperatively configured to form an interfolded stack having the folded width from the stream of first sheets fed along the first path extending through the interfolding nip, or alternatively to form an interfolded stacking having the same folded width from the stream of second sheets fed along the second path extending from the nip.

The first sheet-cutting-and-overlapping arrangement may include a first overlapped roll rotatably mounted in the frame and having a rotational speed and diameter generating a first overlap roll peripheral speed which is faster than the interfolding roll peripheral speed. The second sheet-cutting-and-overlapping arrangement includes a second overlapped roll rotatably mounted in the frame and having a rotational speed and diameter generating a second overlap roll peripheral speed which is faster than the interfolding roll peripheral speed and different from the first overlap roll peripheral speed.

The first sheet-cutting-and-overlapping arrangement includes a first sheet-cutting arrangement mounted in the frame for receiving and cutting the web of material to generate and deliver a stream of the first sheets along the first paths to the first sheet-cutting-and-overlapping arrangement at a first cut-sheet speed substantially equal to the first overlapped roll peripheral speed. The second sheet-cutting-and-overlapping arrangement includes a second sheet-cutting arrangement mounted in the frame for receiving and cutting the web of material to generate and deliver a stream of the second sheets along the second path to the sheet-cutting-and-overlapping arrangement at a second cut-sheet speed substantially equal to the second overlapped roll peripheral speed.

Other aspects, objects and advantages of the invention will be apparent from the following detailed description and accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
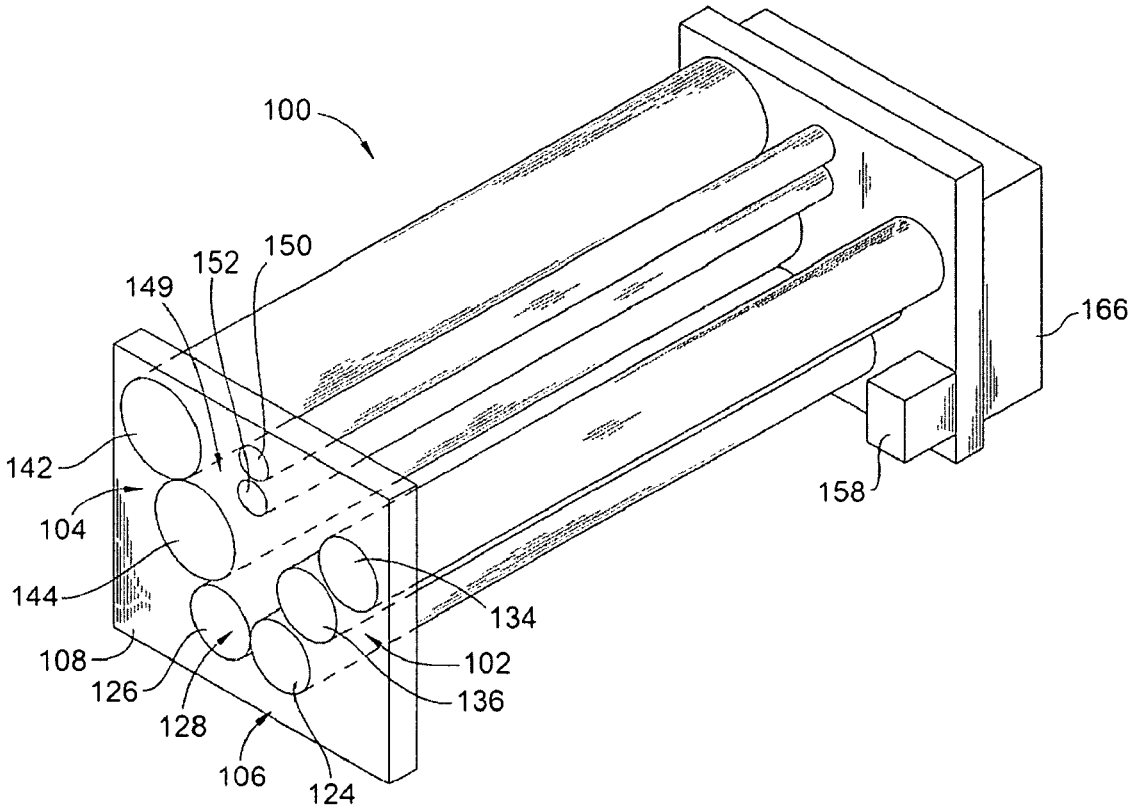
FIG. 1 is a perspective illustration of an exemplary embodiment of a multi-fold interfolding apparatus, according to the invention.

FIG. 1 shows a first exemplary embodiment of a multi-fold interfolding apparatus 100, according to the invention, which utilizes first and second sheet-cutting-and-overlapping arrangements 102, 104, in conjunction with an interfolding arrangement 106, simultaneously mounted and operatively interconnected in a common frame 108, for alternatively selectively forming a first or a second interfolded pattern 110, 112 (see FIGS. 2 and 3) having the same folded width W, without replacement of components of the interfolding apparatus 100.

Figure 2:
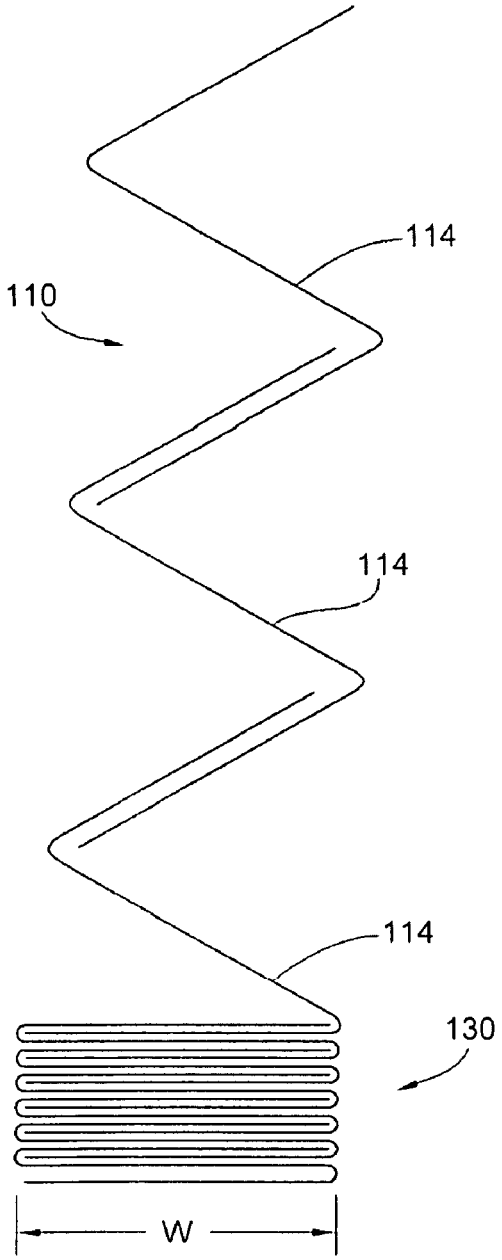
FIG. 2 is a schematic representation of a first interfolded pattern of multi-folded sheets, with each sheet having three panels, formed in accordance with the invention using the apparatus shown in FIG. 1.
Figure 3:
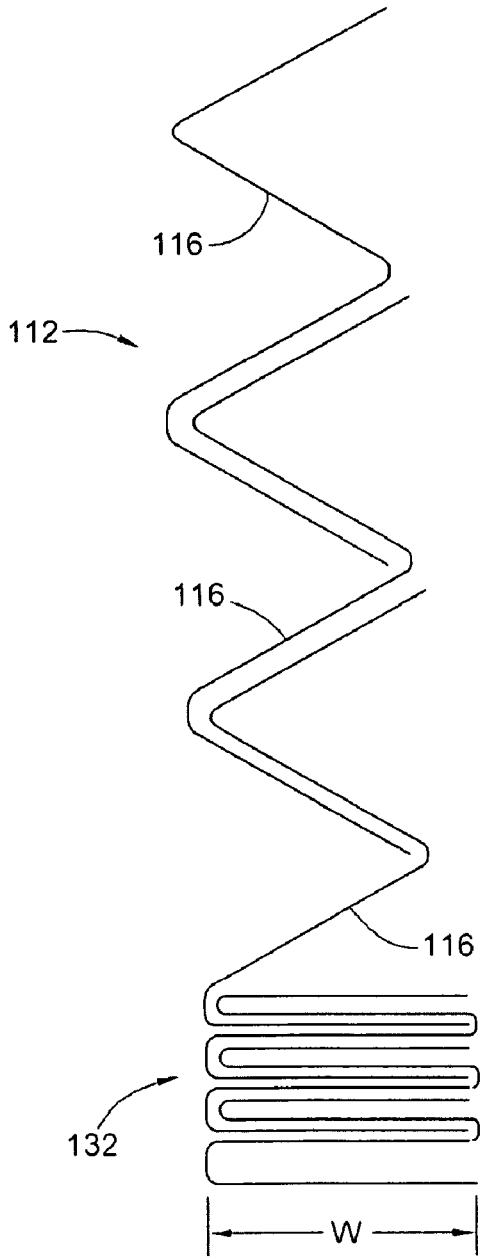
FIG. 3 is a schematic representation of a second interfolded pattern of multi-folded sheets having four panels each, formed in accordance with the invention using the apparatus of FIG. 1.

Specifically, the exemplary embodiment of the multi-fold interfolding apparatus 100 is configured to produce either the first interfolded pattern 110 of three-panel sheets 114, as shown in FIG. 2, or the second interfolded pattern 112 of second sheets 116 having a four-panel configuration, as shown in FIG. 3, within the same interfolding machine 100. As will be understood by comparing FIGS. 4 and 5, this is accomplished by having two web paths 118, 120 through the machine 100, feeding the common interfolding arrangement 106. Threading the web of material 122 along the first web path 118, in the manner shown in FIG. 4, results in the three-panel interfolded product 110 being produced in the manner illustrated in FIG. 3. Alternatively, threading the web 122 through the second web path 120, in the manner shown in FIG. 5, results in the four-panel product 112 shown in FIG. 3 being produced.

As a result, the need to replace the first sheet-cutting-and-overlapping arrangement 102 with the second sheet-cutting-and-overlapping arrangement 104, as would have been the case with prior apparatuses and methods, is eliminated, thus greatly facilitating changing back and forth between production of three-panel and four-panel interfolded products. Those having skill in the art will recognize that, through practice of the invention, two different products can be effectively and efficiently produced within one machine with minimal changeover time and effort consisting substantially of re-threading the web 122 of material. It will be further recognized that, in alternate embodiments of the invention, other combinations of panels, i.e. combinations other than three- and four-panel towels having the same folded width, may be produced according to the invention.

Figure 4:
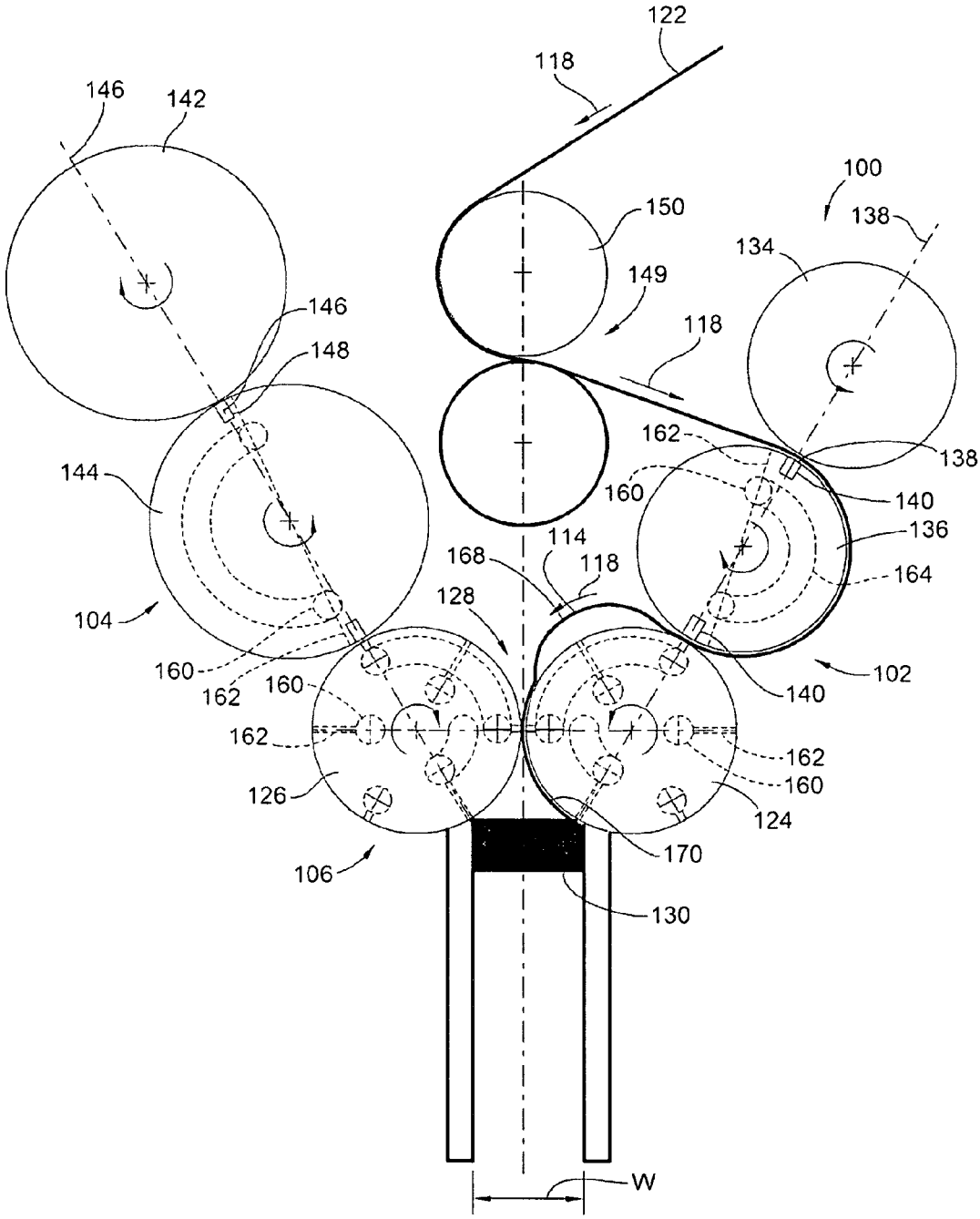
FIG. 4 is a schematic representation of the exemplary embodiment of an apparatus, according to the invention, shown in FIG. 1, with a web of material being fed along a first web path through the interfolding apparatus to form a first stack of interfolded product having a folded width.
Figure 5:
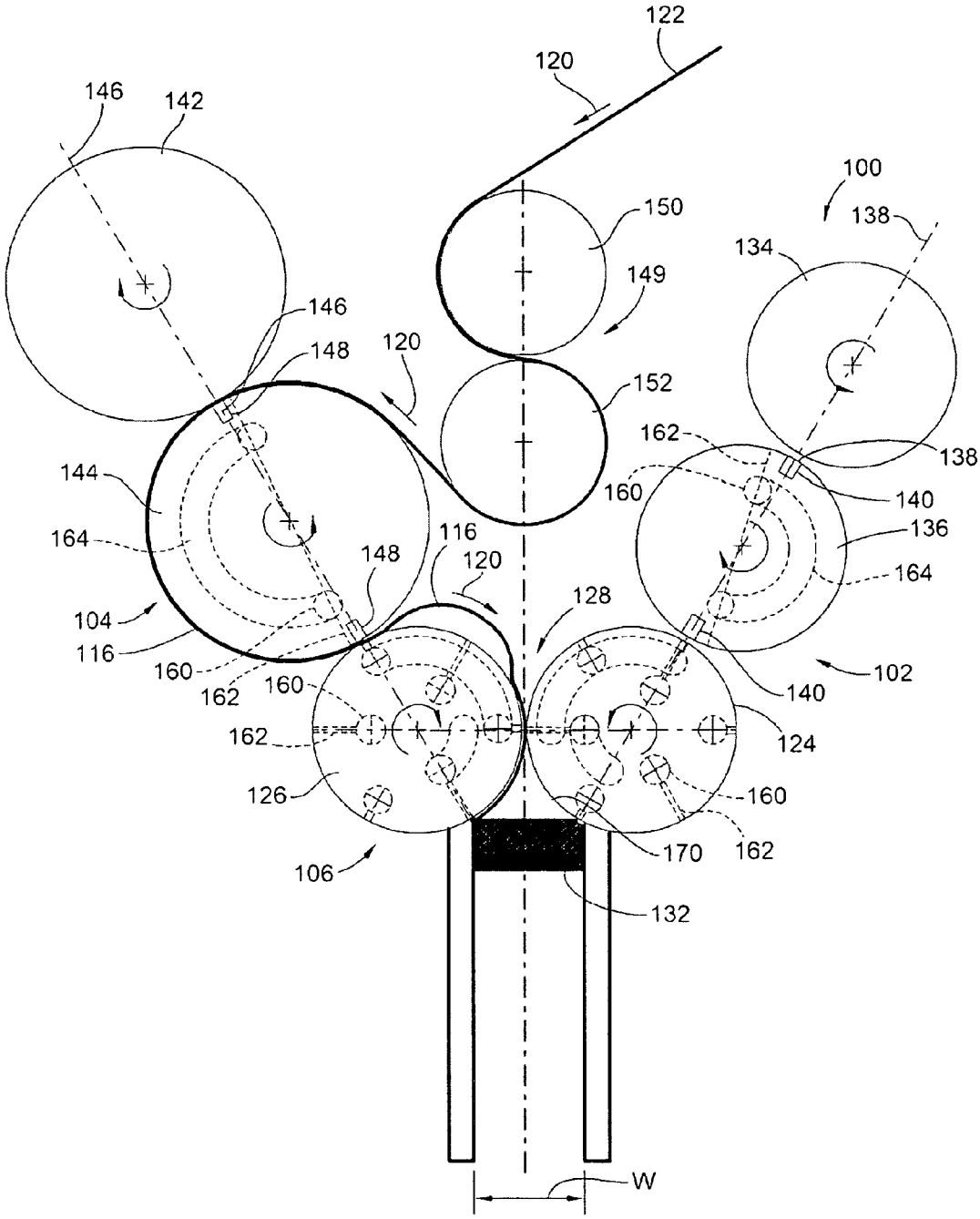
FIG. 5 is a schematic illustration of the apparatus shown in FIGS. 4 and 1, with a web of material threaded through the multi-fold interfolding apparatus along a second web path to form a second stack of interfolded product having the same folded width as the stack of interfolded product formed with the apparatus threaded as shown in FIG. 4.

As shown in FIGS. 1, 4 and 5, the interfolding arrangement 106, of the exemplary embodiment of the multi-fold interfolding apparatus 100 includes a pair of interfolding rolls 124, 126 of substantially the same diameter operatively mounted within the frame 108, by bearings (not shown), for rotation in opposite directions to one another at the same rotational speed, to thereby generate a substantially identical interfolding roll peripheral speed, also referenced herein alternatively as the interfolding feed speed (IFS), for both interfolding rolls 124, 126. The pair of interfolding rolls 124, 126 forms an interfolding nip 128 between the interfolding rolls 124, 126. Both the first path 118, as shown in FIG. 4, and the second path 120 as shown in FIG. 5 extend through the interfolding nip 128.

The interfolding rolls are cooperatively configured to have outer peripheries that include sheet gripping and folding features, of any appropriate type known in the art, configured to form a first interfolded stack 130 having the folded width W from the stream of first sheets 114 fed along the first path 118 extending through the interfolding nip 128, as shown in FIG. 4, or alternatively to form a second interfolded stack 132 having the folded width W from the stream of second sheets 116 fed along the second path 120 extending through the nip 128, as shown in FIG. 5. For example, in various embodiments of the invention, mechanically actuated grippers, tuckers, and vacuum or air blow-off devices or elements may be included as part of the interfolding rolls 124, 126, for use in holding the sheets on the rolls 124, 126 and accomplishing the folding and interfolding operations.

The first sheet-cutting-and-overlapping arrangement 102, in the exemplary embodiment of the multi-fold interfolding apparatus 100, includes a first sheet-cutting arrangement, in the form of a first cutting roll 134, and a first overlap roll 136, mounted in the frame 108 by bearings (not shown). The first cutting roll 134 and the overlap roll 136 are cooperatively configured such that they rotate together at the same speed. A pair of cutters 138 on the cutting roll interact with corresponding notches 140 in the overlap roll 136 in such a manner that as the web 122 is fed between the first cutting roll 134 and the first overlap roll 136, the web of material 122 is cut into a stream of first sheets 114 having a cut length which is substantially equal to three times the folded width W of the stack 130 of the first interfolded pattern 110. When the first sheets 114, with each sheet 114 having a length substantially equal to three times the folded width W, are fed through the interfolding arrangement 106 in a properly timed manner, the resultant folded pattern for the first sheets 114 is a substantially Z-shaped folded form having three panels, with all three panels being substantially equal in width to the folded width W, as shown in FIG. 2.

The first overlap roll 136 is mounted in the frame 108 by bearings (not shown) and has a rotational speed and diameter generating a first overlap roll peripheral speed, alternatively referenced herein as the first overlap speed (FOS), which is substantially one-third faster than the peripheral speed of the interfolding rolls 124, 126. Stated another way, in the exemplary embodiment of the multi-fold interfolding apparatus 100, for the first interfolded pattern 110 formed by the first sheets 114, it is desired to have successive first sheets 114 overlap one another by one panel width, i.e. a distance substantially equal to the folded width W, after passing through the interfolding arrangement 106, in the manner shown in FIG. 2. This is accomplished by running the first overlap roll 136 at a peripheral speed which is one-third faster than the interfolding roll peripheral speed IFS.

In the exemplary embodiment 100, the first sheets 114 have a length which is a first length multiplier (FLM) times the folded width W. Specifically, in the exemplary embodiment, the first length multiplier (FLM) is an integer, i.e. three (3) times the folded width W. The first overlap roll peripheral speed (FOS) in the first exemplary embodiment 100 is faster than the interfolding roll peripheral speed (IFS) by the product of a first overlap multiplier (FOM) times the reciprocal of the first length multiplier (FLM), and can be calculated substantially according to the formula [(FOS)=IFS (1+(FOM)(1/(FLM)))]. For the first sheets 114 in the exemplary embodiment 100, the first overlap multiplier is also an integer, i.e. one (1), corresponding to a desired overlap of adjacent first sheets 114 by approximately one folded panel width W. Plugging the numbers into the formula, yields a first overlap speed FOS for the periphery of the first overlap roll 136 which is ⅓ faster than the interfolding feed speed IFS of the periphery of the interfolding rolls 124, 126: [(FOS)=IFS (1+(1)(1/(3)))=IFS (1+⅓)].

It will be appreciated that, although the cut length of the first sheets 114, and the first overlap multiplier FOM were both integers in the exemplary embodiment 100, to cause the overlapping to begin and end substantially at a fold in the first sheets 114, in other embodiments of the invention it may be desired to have one or both of the first sheet cut length or the first overlap multiplier FOM be a non-integer value, so as to have the beginning or ending of the overlap occur in an "off-fold" location.

The second sheet-cutting-and-overlapping arrangement 104, in the exemplary embodiment of the multi-fold interfolding apparatus 100, includes a second sheet-cutting arrangement, in the form of a second cutting roll 142, and a second overlap roll 144, mounted in the frame 108 by bearings (not shown). The second cutting roll 142 and the second overlap roll 144 have larger diameters than their counterparts (134,136) in the first sheet-cutting-and-overlapping arrangement 102, and are cooperatively configured such that they rotate together at the same speed. A pair of cutters 146 on the second cutting roll 142 interact with corresponding notches 148 in the second overlap roll in such a manner that as the web 122 is fed between the second cutting roll 142 and the second overlap roll 144, the web of material 122 is cut into a stream of second sheets 116 having a cut length which is substantially equal to four times the folded width W. When the second sheets 116, having a length substantially equal to four times the folded width W, are fed through the interfolding arrangement 106 in a properly timed manner, the resultant folded pattern for the second sheets will be substantially a substantially W-shaped folded form having four panels equal in width to the folded width W, as shown in FIG. 3.

The second overlap roll 142 is mounted in the frame 108, by bearings (not shown), and has a rotational speed and diameter generating a second overlap roll peripheral speed which is substantially one-half faster than the peripheral speed IFS of the interfolding rolls 124, 126. Stated another way, in the exemplary embodiment of the multi-fold interfolding apparatus 100, for the second interfolded pattern 112 formed by the second sheets 116, it is desired to have successive second sheets 116 overlap one another by two panel widths W, i.e. a distance substantially equal to twice the folded width W, after passing through the interfolding arrangement 106, in the manner shown in FIG. 3. This is accomplished by running the second overlap roll 144 at a peripheral speed, (i.e. at a second overlap speed SOS), which is half-again higher than the interfolding roll peripheral speed IFS, to achieve a desired overlapping effect in the second interfolding pattern 112

In the exemplary embodiment 100, the second sheets 116 have a length which is a second length multiplier (SLM) times the folded width. Specifically, the second length multiplier (SLM) is an integer, i.e. four (4) times the folded width W. The second overlap roll peripheral speed (SOS) in the exemplary embodiment 100 is faster than the interfolding roll peripheral speed (IFS) by the product of a second overlap multiplier (SOM) times the reciprocal of the second length multiplier (SLM), and can be calculated substantially according to the formula [(SOS)=IFS (1+(SOM)(1/(SLM)))]. For the second sheets 116 in the exemplary embodiment 100, the second overlap multiplier SOM is also an integer, i.e. two (2), corresponding to a desired overlap of adjacent second sheets 116 by approximately two folded panel widths W. Plugging the numbers into the formula, yields a second overlap speed SOS for the periphery of the second overlap roll 144 which is ½ faster than the interfolding feed speed IFS of the periphery of the interfolding rolls 124, 126: [(SOS)=IFS (1+(2)(1/(4)))=IFS(1+2/4)=IFS(1+½)].

It will be appreciated that, although the cut length of the second sheets 116, and the first overlap multiplier FOM were both integers in the exemplary embodiment 100, to cause the overlapping to begin and end substantially at a fold in the second sheets 116, in other embodiments of the invention it may be desired to have one or both of the second sheet cut length or the second overlap multiplier SOM be a non-integer value, so as to have the beginning or ending of the overlap occur in an "off-fold" location.

Figure 6:
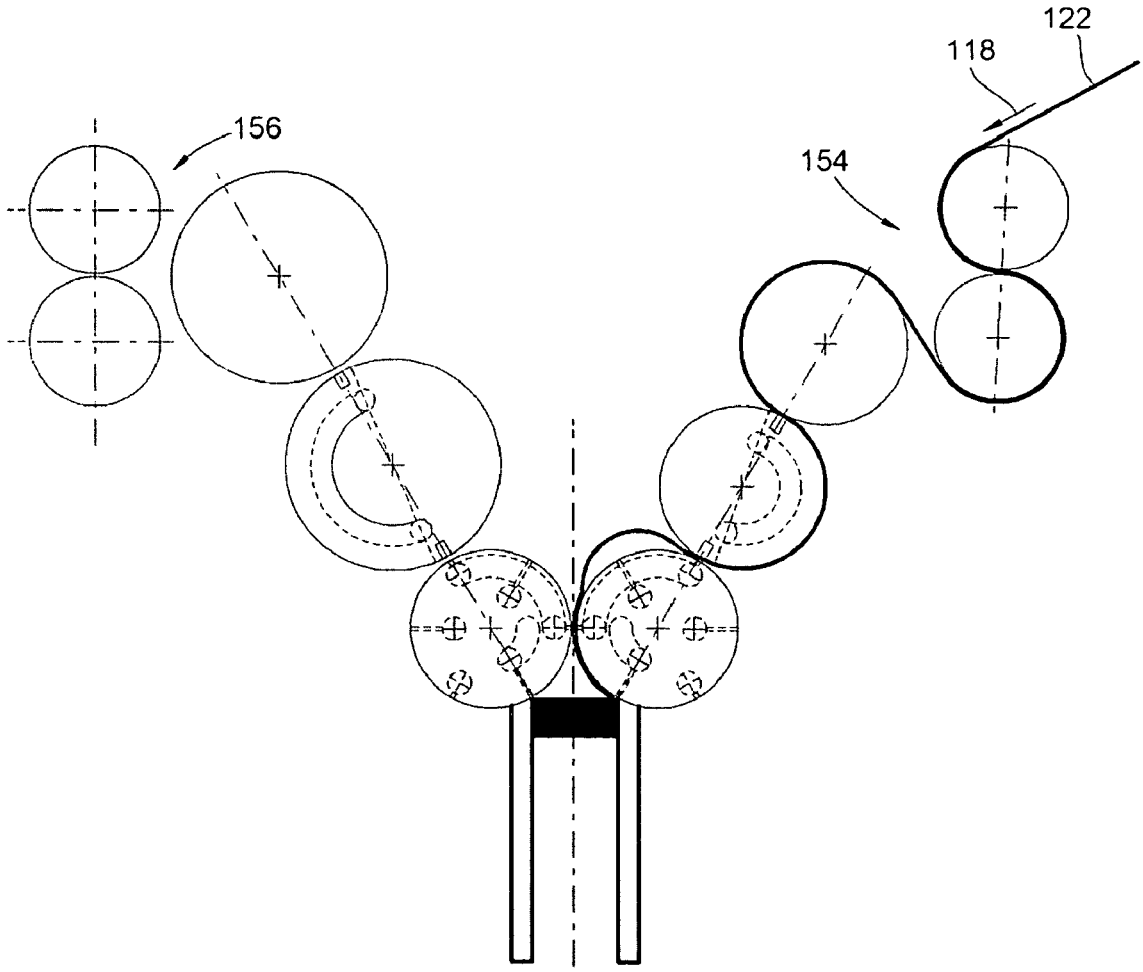
FIG. 6 illustrates an alternate exemplary embodiment of a multi-fold interfolding apparatus, according to the invention, having two sets of pull rolls, rather than a single set of pull rolls as utilized in the embodiment shown in FIGS. 1-5.

As shown in FIGS. 1, 4 and 5, the exemplary embodiment of the multi-fold interfolding apparatus 100 also includes a common web-pulling arrangement 149, in the form of a pair of common pull rolls 150, 152, mounted to the frame 108 by bearings (not shown). The common pull rolls 150, 152 are mounted in such a fashion that the web of material 122 can be fed through the common pull rolls 150, 152 along the first path 118, in the manner shown in FIG. 4, or alternatively be fed through the common pull rolls 150, 152 along the second path 120, as shown in FIG. 5. In other embodiments of the invention, it is contemplated that other web pulling arrangements may be utilized. For example, as illustrated in FIG. 6, some embodiments of the invention may include a first pulling arrangement 154, which is utilized only for feeding the web of material 122 along the first path 118, and a second web pulling arrangement 156, which is utilized only for feeding the web of material 122 along the second path 120.

As previously indicated, it is contemplated that, in practicing the invention, the interfolding rolls 124, 126, the first overlap roll 136 and the second overlap roll 144 will include appropriate elements or devices, such as mechanical grippers, tuckers, vacuum ports, etc., for securing the streams of sheets 114, 116 to the rolls 124, 126, 136, 144 during portions of their travel along the first or second web paths 118, 120. For purposes of illustration, FIGS. 4 and 5 include illustrations of a vacuum operated system, for selectively applying vacuum from a source of vacuum 158, as shown in FIG. 1, to the interfolding rolls 124, 126, the first overlap roll 114 and the second overlap roll 144. Specifically, in FIGS. 4 and 5, the interfolding rolls 124, 126, the first overlap roll 136 and the second overlap roll 144 all include a series of axial bores 160, represented by circles formed from hidden lines in FIGS. 4 and 5, which connect vacuum ports 162 extending generally radially outward through the surfaces of the rolls 124, 126, 136, 144, to the source of vacuum 158, via vacuum manifold ports in the frame 108 which are illustrated in FIGS. 4 and 5 by arcuate-shaped slots 164 formed from hidden lines. For clarity of illustration, not all of the axial bores 160, vacuum ports 162, and arcuate channels 164 of the vacuum manifold, are labeled with reference numerals in FIGS. 4 and 5.

In the exemplary embodiment of the invention, the vacuum source 158 and vacuum manifold 164 in the frame 108 are configured in such a manner that the axial bores 160 and vacuum ports 162 in the second overlap roll 144 may be disconnected from the source of vacuum 158 when the web of material 122 is being fed along the first web path 118, and conversely so that the axial bores 160 and the vacuum ports 162 in the first overlap roll 136 can be disconnected from the source of vacuum 158 when the web of material 122 is being fed along the second web path 120. It is contemplated, however, that in other embodiments of the invention, the axial bores 160 and vacuum ports in both the first and second overlap rolls 136, 144 may be left connected to the source of vacuum 158 regardless of whether the web of material 122 is being fed along the first or the second web path 118, 120.

As shown in FIG. 1, the exemplary embodiment of the multi-fold interfolding apparatus 100 also includes a drive arrangement 166, which is operatively connected to all of the rolls 124, 126, 134, 136, 142, 144, 150, 152, for operating the multi-fold interfolding apparatus 100 with the web of material 122 being fed down either the first web path 118 or the second web path 120. In the exemplary embodiment, the drive arrangement 166 is configured for selectively disconnecting the drive connection to the second cutting roll 142 and the second overlap roll 144, when the web of material 122 is being fed along the first web path 118, and in similar fashion, for disconnecting the drive arrangement 166 from the first cutting roll 134 and the first overlap roll 136, when the web of material 122 is being fed along the second web path 120. It is contemplated, however, that in other embodiments of the invention, different drive arrangements may be utilized such that all of the cutting and overlap rolls 134, 136, 142, 144 are driven at all times, regardless of whether the web of material 122 is being fed along the first web path 118 or the second web path 120.

It is further contemplated, that in various embodiments of the invention, a variety of vacuum supply and drive arrangements may be utilized, other than those specifically described herein.

Figure 7:
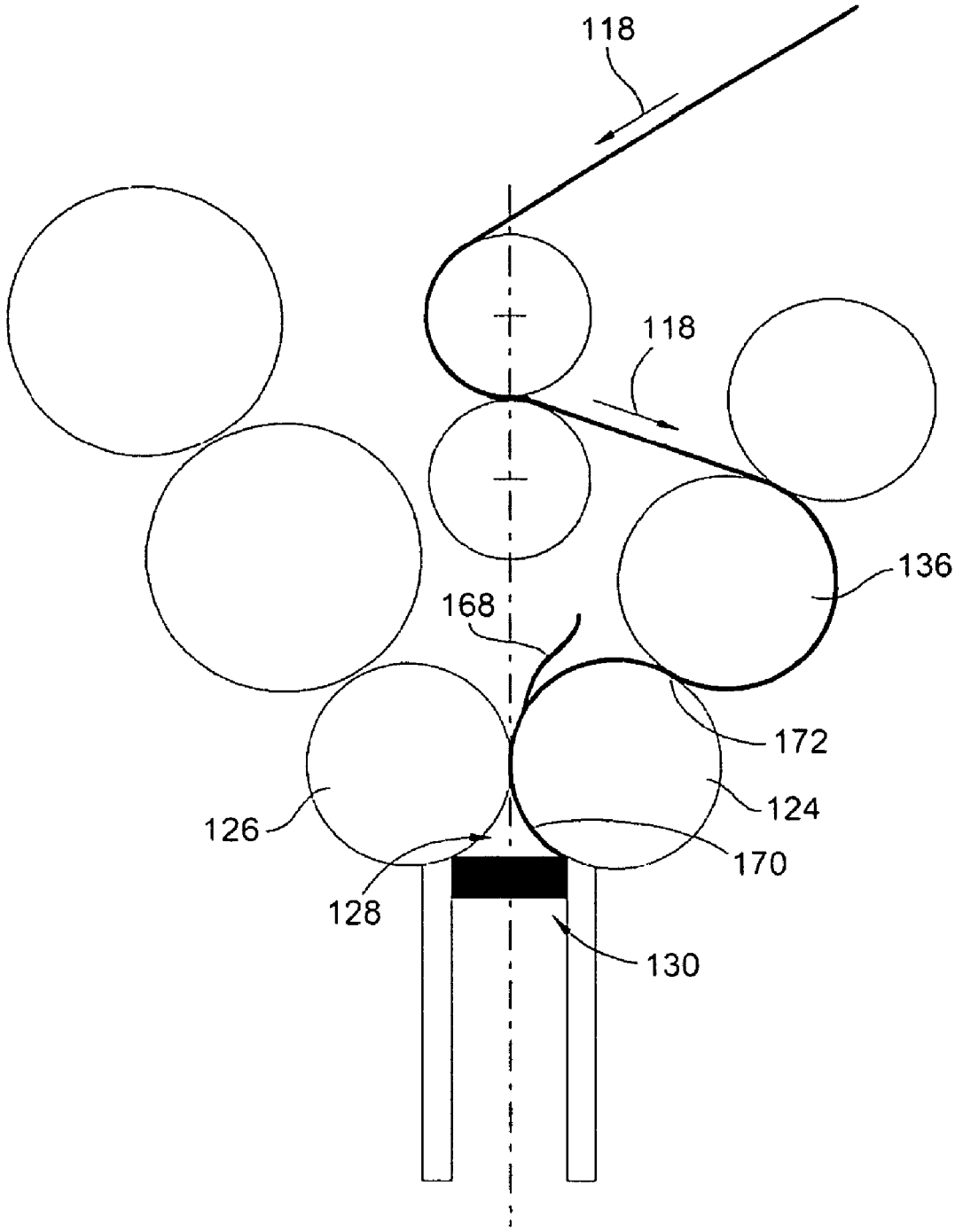
FIG. 7 is a schematic illustration which, in combination with FIG. 4, shows the manner in which overlapping is accomplished in the exemplary apparatus of FIGS. 1-5, with the web of material threaded along the first web path.

FIGS. 4 and 7 further illustrate the operation of the exemplary embodiment of the multi-fold interfolding apparatus 100, with the web of material 122 being fed along the first web path 118, to form the stack 130 of interfolded three-panel sheets 114, as shown in FIG. 2. Interaction of the first overlap roll 136 with the interfolding rolls 124, 126, in generally the same manner as described in previously referenced U.S. Published Patent Application No. US 2007/0082800, causes successive first sheets 114 in the first stream of sheets 114 to be overlapped and interfolded to form the first stack 130 of interfolded three-panel sheets 114. Specifically, FIGS. 4 and 7 illustrate successive steps, respectively, in processing a reference sheet 168 of the stream of first sheets 114, a previous sheet 170 of the stream of first sheets 114, and a following sheet 172 of the stream of sheets 114. Stated another way, the previous sheet 170 is the sheet 114 in the first stream of sheets which immediately precedes the reference sheet 168, and the following sheet 172 is the sheet 114 of the first stream of sheets which immediately follows the reference sheet 168 as the previous sheet 170, the reference sheet 168 and the following sheet 172 travel along the first path 118.

In the position illustrated in FIG. 4, a portion of the reference sheet 168 adjacent the leading edge of reference sheet 168 is positioned beneath a portion of the previous sheet 172 adjacent the trailing edge of the previous sheet 172, within the nip 128 between the interfolding rolls 124, 126. The trailing end of the reference panel 168 has not yet been completely transferred from the overlap roll 136 to the interfolding roll 124. Because the interfolding roll 124 has a peripheral speed which is slower than the overlap roll 136, a portion of the reference sheet 168 adjacent the trailing edge of the sheet 168 bulges outward from the interfolding roll 124, in the manner illustrated in FIG. 4.

As the reference sheet 168 continues along the path 118, the trailing edge of the reference sheet 168 is released by the overlap roll 136, and, due to rotational forces generated by the interfolding roll 124, and the fact that the axial bores 160 in the interfolding roll 124 are positioned to retain only a portion of the reference sheet 168 adjacent the leading edge of the reference sheet 168 in contact with the periphery of the interfolding roll 124, the trailing edge of the reference sheet 168 pulls away from the interfolding roll 124, in the manner shown in FIG. 7. As further shown in FIG. 7, the axial bores 160 in the interfolding roll 124 are positioned and configured to receive the leading edge of the following sheet 172 and hold a portion of the following sheet 172 adjacent the leading edge of the sheet 172 in contact with the interfolding roll 124. As the reference sheet 168 and the following sheet 172 proceed further along the path 118, toward the nip 128 between the interfolding rolls 124, 126, the portion of the reference sheet 168 which is not being held in contact with the surface of the interfolding roll 124 is overlapped onto the portion of the following sheet 172 adjacent the leading edge of the following sheet 172, in such a manner that, as the overlapped portions of the reference and following sheets 168, 172 pass through the nip 128, the reference and following sheets 172 are formed into the first interfolded pattern shown in FIG. 2.

Figure 8:
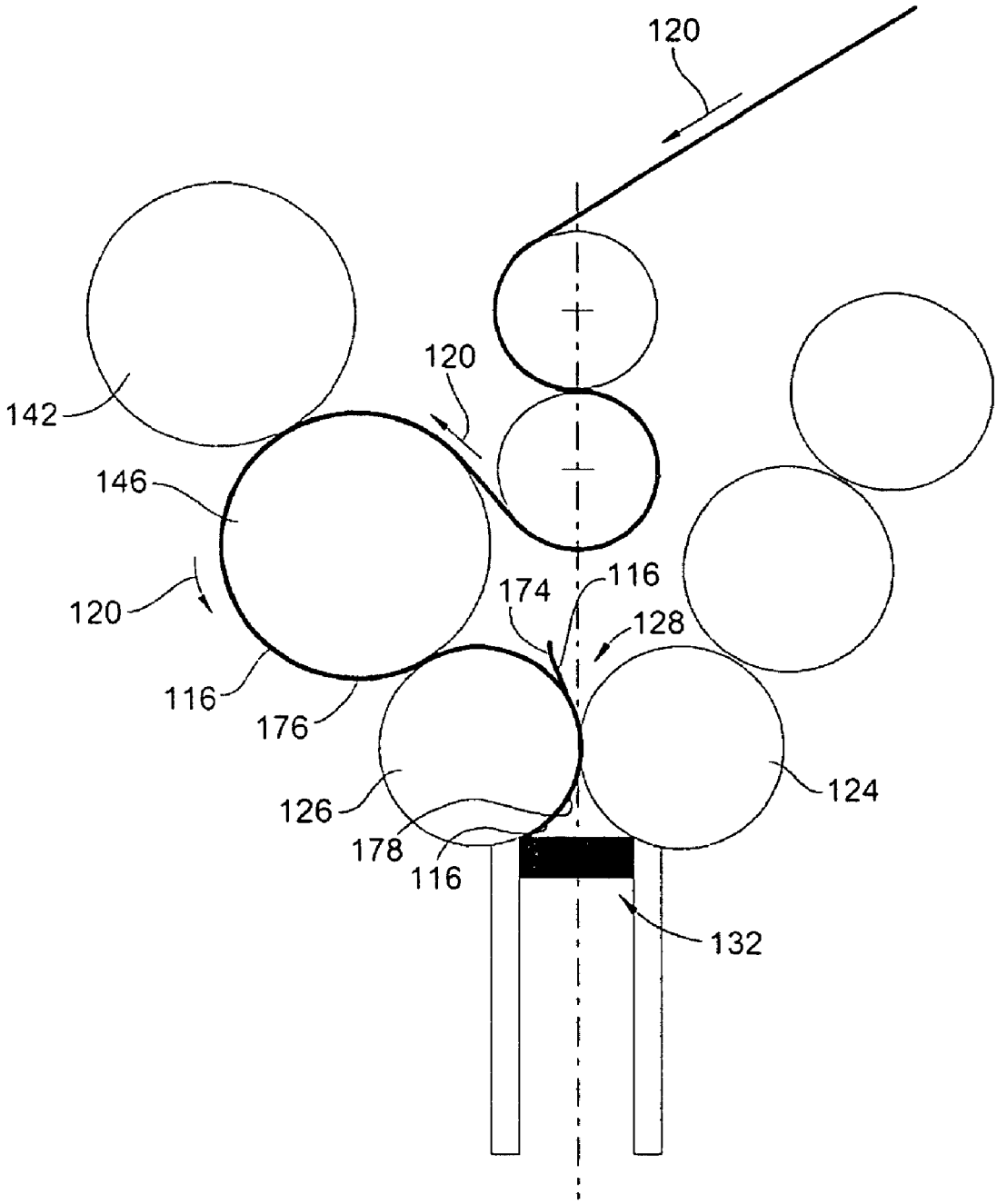
FIG. 8 is a schematic illustration which, together with FIG. 4, shows the manner in which overlapping of successive sheets is accomplished in the exemplary apparatus of FIGS. 1-5, with a web of material fed along the second web path.

FIGS. 5 and 8 further illustrate the operation of the exemplary embodiment of the multi-fold interfolding apparatus 100, with the web of material 122 being fed along the second web path 120, to form the second stack 132 of interfolded four-panel sheets 116, as shown in FIG. 3. Interaction of the second overlap roll 144 with the interfolding rolls 124, 126, in generally the same manner as described in previously referenced U.S. Published Patent Application No. US 2007/0082800, causes successive second sheets 116 in the second stream of sheets 116 to be overlapped and interfolded to form the second stack 132 of interfolded sheets 116. Specifically, FIGS. 5 and 8 illustrate a reference sheet 174 of the stream of second sheets 116, a previous sheet 176 of the stream of second sheets 116, and a following sheet 178 of the stream of sheets 116. Stated another way, the previous sheet 176 is the sheet 116 in the second stream of sheets 116 which immediately precedes the reference sheet 174, and the following sheet 178 is the sheet 116 of the second stream of sheets 116 which immediately follows the reference sheet 174 as the previous sheet 176, the reference sheet 174 and the following sheet 178 travel along the second path 120.

In the position illustrated in FIG. 5, a portion of the reference sheet 168 adjacent the leading edge of the reference sheet 174 is positioned beneath a portion of the previous sheet 176, adjacent the trailing edge of the previous sheet 176, within the nip 128 between the interfolding rolls 124, 126. The trailing edge of the reference panel 174 has not yet been completely transferred from the second overlap roll 144 to the interfolding roll 126. Because the interfolding roll 126 has a peripheral speed which is slower than the second overlap roll 144, a portion of the reference sheet 174 adjacent the trailing edge of the reference sheet 174 bulges outward from the interfolding roll 126, in the manner illustrated in FIG. 5.

As the reference sheet 174 continues along the path 120, the trailing edge of the reference sheet 174 is released by the second overlap roll 144, and, due to rotational forces generated by the interfolding roll 126, and the fact that the axial bores 160 in the interfolding roll 126 are positioned to retain only a portion of the reference sheet 174 adjacent the leading edge of the reference sheet 174 in contact with the periphery of the interfolding roll 126, the trailing edge of the reference sheet 174 pulls away from the interfolding roll 126, in the manner shown in FIG. 8. As further shown in FIG. 8, the axial bores 160 in the interfolding roll 126 are positioned and configured to receive the leading edge of the following sheet 178 and hold a portion of the following sheet 178 adjacent the leading edge of the following sheet 178 in contact with the interfolding roll 126. As the reference sheet 174 and the following sheet 178 proceed further along the path 120, toward the nip 128 between the interfolding rolls 124, 126, the portion of the reference sheet 174 which is not being held in contact with the surface of the interfolding roll 126 is overlapped onto the portion of the following sheet 178 adjacent the leading edge of the following sheet 178, in such a manner that, as the overlapped portions of the reference and following sheets 174, 178 pass through the nip 128, the reference and following sheets 174, 178 are formed into the second interfolded pattern 132 shown in FIG. 3.

It will be understood, by those having skill in the art, that a multi-fold interfolding apparatus or method, according to the invention, may utilize additional components or any appropriate mechanism known in the art.

Those having skill in the art will also recognize that the invention may be practiced with a variety of apparatuses which differ in structure and operation from the exemplary embodiments described above. For example, it is contemplated that in other embodiments of the invention, it may be desirable to form the cut sheets, from a web of material, utilizing a sheet-cutting arrangement which does not include a cutting wheel. It is further expressly contemplated that the overlapping arrangement in other embodiments of the invention may include additional rolls, or other types of guiding arrangements than those specifically described hereinabove.

Those having skill in the art will further recognize that, although the invention has been described herein in conjunction with exemplary embodiments utilizing only two web paths extending through the same interfolding arrangement, it is contemplated that, in other embodiments of the invention, a multi-fold interfolding apparatus or method, according to the invention, may include additional web paths, i.e. more than 2 web paths, fed through the same interfolding arrangement.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A multi-path interfolding apparatus, comprising, first and second sheet-cutting-and-overlapping arrangements and an interfolding arrangement, simultaneously mounted and operatively interconnected in a common frame, for alternatively selectively forming a first interfolded pattern having a folded width from overlapped sheets of a first length cut from a web of sheet material fed along a first path extending through the first sheet-cutting-and-overlapping arrangement to the interfolding arrangement, or forming a second interfolded pattern having the same folded width from overlapped sheets of a second length cut from the web of sheet material fed along a second path extending through the second sheet-cutting-and-overlapping arrangement to the interfolding arrangement.

2. The multi-path interfolding apparatus of claim 1, wherein:

the interfolding apparatus is configured to move the streams of sheets through the interfolding arrangement at an interfolding feed speed (IFS);

the first sheet-cutting-and-overlapping arrangement is configured for generating a first overlap speed (FOS) which is higher than the interfolding feed speed (IFS); and the second sheet-cutting-and-overlapping arrangement is configured for generating a second overlap speed (SOS) which is higher than the interfolding feed speed (IFS) and different from the first overlap speed (FOS).

3. The multi-path interfolding apparatus of claim 2, wherein:

the first sheet length is substantially equal to a first length multiplier (FLM) of the folded width; and the second sheet length is substantially equal to a second length multiplier (SLM) of the folded width.

4. The multi-path interfolding apparatus of claim 3, wherein:

the first overlap speed (FOS) is the product of a first overlap multiplier (FOM) times the reciprocal of the first length multiplier (FLM) faster than the interfolding feed speed (IFS), substantially according to the formula [(FOS) =IFS (1+(FOM)(1/(FLM)))]; and the second overlap speed (SOS) is the product of a second overlap multiplier (SOM) times the reciprocal of the second length multiplier (SLM) faster than the interfolding feed speed (IFS), substantially according to the formula, [(SOS)=IFS (1+(SOM)(1/(SLM)))].

5. The multi-path interfolding apparatus of claim 4, wherein, at least one of the first and second length and overlap multipliers (FLM), (SLM), (FOM), (SOM) is an integer.

6. The multi-path interfolding apparatus of claim 1, wherein, at least one of the first and second sheet lengths is substantially equal to an integer multiple of the folded width.

7. The multi-path interfolding apparatus of claim 1, wherein:

the first sheet-cutting-and-overlapping arrangement is configured for generating a stream of first sheets having a first sheet length; and the second sheet-cutting-and-overlapping arrangement is configured for generating a stream of second sheets having a second sheet length different from the first sheet length.

8. The multi-path interfolding apparatus of claim 7, wherein, at least one of the first and second sheet lengths is substantially equal to an integer multiple of the folded width.

9. The multi-path interfolding apparatus of claim 8, wherein, both the first and second sheet lengths are substantially equal to integer multiples of the folded width.

10. The multi-path interfolding apparatus of claim 1, wherein, the interfolding arrangement includes a pair of interfolding rolls operatively mounted in the frame for rotation in opposite directions to one another and forming an interfolding nip therebetween, with the interfolding rolls being cooperatively configured to form an interfolded stack having the folded width from a stream of the first sheets fed along a first path extending through the interfolding nip, or alternatively to form an interfolded stack having the folded width from a stream of the second sheets fed along a second path extending through the nip.

11. The multi-path interfolding apparatus of claim 10, wherein:

the interfolding rolls both rotate at the same speed and are of the same diameter, such that rotation of the interfolding rolls causes an interfolding roll peripheral speed (IFS);

the first sheet-cutting-and-overlapping arrangement comprises a first overlap roll rotatably mounted in the frame and having a rotational speed and diameter generating a first overlap roll peripheral speed (FOS) which is higher than the interfolding roll peripheral speed (IFS); and the second sheet-cutting-and-overlapping arrangement comprises a second overlap roll rotatably mounted in the frame and having a rotational speed and diameter generating a second overlap roll peripheral speed (SOS) which is higher than the interfolding roll peripheral speed (IFS) and different from the first overlap roll peripheral speed (FOS).

12. The multi-path interfolding apparatus of claim 11, wherein:

the first sheet-cutting arrangement further comprises a first-sheet-cutting-roll rotatably mounted in the frame and having a rotational speed and diameter generating a first-sheet-cutting-roll peripheral speed which is substantially equal to the first overlapping roll peripheral speed (FOS), the first sheet-cutting roll being configured for receiving the web of material and cutting the web into the first sheets at the first sheet length and delivering a stream of the first sheets along the first path to the first overlapping roll at a speed equal to the first overlapping roll peripheral speed (FOS); and the second sheet-cutting arrangement further comprises a second-sheet-cutting-roll rotatably mounted in the frame and having a rotational speed and diameter generating a second-sheet-cutting-roll peripheral speed which is substantially equal to the second overlapping roll peripheral speed (SOS), the second sheet-cutting roll being configured for receiving the web of material and cutting the web into the second sheets at the second sheet length and delivering a stream of the second sheets along the second path to the second overlapping roll at a speed equal to the second overlapping roll peripheral speed (SOS).

13. The multi-path interfolding apparatus of claim 12, wherein:

the first sheet length is substantially equal to a first length multiplier (FLM) of the folded width; and the second sheet length is substantially equal to a second length multiplier (SLM) of the folded width.

14. The multi-path interfolding apparatus of claim 13, wherein:

the first overlap roll peripheral speed (FOS) is the product of a first overlap multiplier (FOM) times the reciprocal of the first length multiplier (FLM) faster than the interfolding roll peripheral speed (IFS), substantially according to the formula [(FOS)=IFS (1+(FOM)(1/(FLM)))]; and the second overlap roll peripheral speed (SOS) is the product of a second overlap multiplier (SOM) times the reciprocal of the second length multiplier (SLM) faster than the interfolding roll peripheral speed (IFS), substantially according to the formula, [(SOS)=IFS (1+(SOM)(1/(SLM)))].

15. The multi-path interfolding apparatus of claim 14, wherein, at least one of the first and second length and overlap multipliers (FLM), (SLM), (FOM), (SOM) is an integer.

16. A multi-path interfolding method, comprising:

simultaneously mounting and operatively connecting first and second sheet-cutting-and-overlapping arrangements and an interfolding arrangement in a common frame to form an interfolding apparatus; and alternatively selectively forming a first interfolded pattern having a folded width from overlapped sheets of a first length cut from a web of sheet material fed along a first path extending through the first sheet-cutting-and-overlapping arrangement to the interfolding arrangement, or forming a second interfolded pattern having the same folded width from overlapped sheets of a second length cut from the web of sheet material fed along a second path extending through the second sheet-cutting-and-overlapping arrangement to the interfolding arrangement.

17. The multi-path interfolding method of claim 16, further comprising:

threading the web of material through the first cutting-and-overlapping arrangement; and operating the first cutting-and-overlapping arrangement and the interfolding arrangement to form the first interfolded pattern of overlapped first sheets.

18. The multi-path interfolding method of claim 17, further comprising:

unthreading the web of material from the first cutting-and-overlapping arrangement and the interfolding arrangement; then threading the web of material through the second cutting-and-overlapping arrangement; and then operating the second cutting-and-overlapping arrangement and the interfolding arrangement to form the second interfolded pattern of overlapped second sheets.

19. The multi-path interfolding method of claim 17 further comprising, shutting down the second cutting-and-overlapping arrangement while operating the first cutting-and-overlapping arrangement and the interfolding arrangement to form the first interfolded pattern of overlapped first sheets.

20. The multi-path interfolding method of claim 17, wherein, the second cutting-and-overlapping arrangement utilizes a vacuum for manipulating the second sheets as they travel along the second path, and the method further comprises, shutting off the vacuum to the second sheet-cutting-and-overlapping arrangement during operation of the first cutting-and-overlapping arrangement and the interfolding arrangement to form the first interfolded pattern of overlapped first sheets.

21. A multi-path interfolding apparatus comprising:

first and second sheet-cutting-and-overlapping arrangements and an interfolding arrangement, simultaneously mounted and operatively interconnected in a common frame, for alternatively selectively forming a first interfolded pattern having a folded width from overlapped sheets of a first length cut from a web of sheet material fed along a first path extending through the first sheet-cutting-and-overlapping arrangement to the interfolding arrangement, or forming a second interfolded pattern having the same folded width from overlapped sheets of a second length cut from the web of sheet material fed along a second path extending through the second sheet-cutting-and-overlapping arrangement to the interfolding arrangement;

the interfolding arrangement including, a pair of interfolding rolls of substantially the same diameter operatively mounted for rotation in opposite directions to one another at the same rotational speed to thereby generate a substantially identical interfolding roll peripheral speed (IFS);

the pair of interfolding rolls forming an interfolding nip therebetween, with both the first and second paths extending through the interfolding nip, the interfolding rolls being cooperatively configured to form an interfolded stack having the folded width from the stream of the first sheets fed along the first path extending through the interfolding nip, or alternatively to form an interfolded stack having the folded width from the stream of the second sheets fed along a second path extending through the nip;

the first sheet-cutting-and-overlapping arrangement including a first overlap roll rotatably mounted in the frame and having a rotational speed and diameter generating a first overlap roll peripheral speed (FOS) which is faster than the interfolding roll peripheral speed (IFS);

the second sheet-cutting-and-overlapping arrangement including a second overlap roll rotatably mounted in the frame and having a rotational speed and diameter generating a second overlap roll peripheral speed (SOS) which is faster than the interfolding roll peripheral speed (IFS) and faster than the first overlap roll peripheral speed (FOS);

the first sheet-cutting-and-overlapping arrangement also including a first sheet cutting arrangement mounted in the frame for receiving and cutting the web of material to generate and deliver a stream of the first sheets along the first path to the first sheet-cutting-and-overlapping arrangement at a first cut-sheet speed substantially equal to the first overlap roll peripheral speed (FOS);

the second sheet-cutting-and-overlapping arrangement also including a second sheet-cutting arrangement mounted in the frame for receiving and cutting the web of material to generate and deliver a stream of the second sheets along the second path to the second sheet-cutting-and-overlapping arrangement at a second cut-sheet speed substantially equal to the second overlap roll peripheral speed (SOS).

22. The multi-path interfolding apparatus of claim 21, wherein:

the first sheet-cutting arrangement further comprises a first-sheet-cutting-roll rotatably mounted in the frame and having a rotational speed and diameter generating a first-sheet-cutting-roll peripheral speed which is substantially equal to the first overlap roll peripheral speed (FOS), the first sheet-cutting roll being configured for receiving the web of material and cutting the web into the first sheets at the first sheet length and delivering a stream of the first sheets along the first path to the first overlap roll at a speed equal to the first overlap roll peripheral speed (FOS); and the second sheet-cutting arrangement further comprises a second-sheet-cutting-roll rotatably mounted in the frame and having a rotational speed and diameter generating a second-sheet-cutting-roll peripheral speed which is substantially equal to the second overlap roll peripheral speed (SOS), the second sheet-cutting roll being configured for receiving the web of material and cutting the web into the second sheets at the second sheet length and delivering a stream of the second sheets along the second path to the second overlap roll at a speed equal to the second overlap roll peripheral speed (SOS).

23. The multi-path interfolding apparatus of claim 22, wherein:

the first sheet length is substantially equal to a first length multiplier (FLM) of the folded width; and the second sheet length is substantially equal to a second length multiplier (SLM) of the folded width.

24. The multi-path interfolding apparatus of claim 23, wherein:

the first overlap roll peripheral speed (FOS) is the product of a first overlap multiplier (FOM) times the reciprocal of the first length multiplier (FLM) faster than the interfolding roll peripheral speed (IFS), substantially according to the formula [(FOS)=IFS (1+(FOM)(1/(FLM)))]; and the second overlap roll peripheral speed (SOS) is the product of a second overlap multiplier (SOM) times the reciprocal of the second length multiplier (SLM) faster than the interfolding roll peripheral speed (IFS), substantially according to the formula, [(SOS)=IFS (1+(SOM)(1/(SLM)))].

25. The multi-path interfolding apparatus of claim 24, wherein, at least one of the first and second length and overlap multipliers (FLM), (SLM), (FOM), (SOM) is an integer.

26. The multi-path interfolding apparatus of claim 25, wherein:

the first sheet length is substantially equal to three times the folded width;

the second sheet length is substantially equal to four times the folded width;

the first overlapping roll peripheral speed (FOS) is one third faster than the interfolding roll peripheral speed (IFS); and the second overlapping roll peripheral speed (SOS) is one half faster than the interfolding roll peripheral speed (IFS).

* * * * *